US008322173B2

(12) United States Patent
Senba

(10) Patent No.: US 8,322,173 B2
(45) Date of Patent: Dec. 4, 2012

(54) METHOD AND APPARATUS FOR UTILIZING BENDING MACHINE DIE LAYOUT

(75) Inventor: Akira Senba, Isehara (JP)

(73) Assignee: Amada Company, Limited, Kanagawa (JP)

( * ) Notice: Subject to any disclaimer, the term of this patent is extended or adjusted under 35 U.S.C. 154(b) by 525 days.

(21) Appl. No.: 12/307,004

(22) PCT Filed: Jul. 5, 2007

(86) PCT No.: PCT/JP2007/063479

§ 371 (c)(1),
(2), (4) Date: Mar. 10, 2009

(87) PCT Pub. No.: WO2008/004627

PCT Pub. Date: Jan. 10, 2008

(65) Prior Publication Data

US 2009/0308130 A1 Dec. 17, 2009

(30) Foreign Application Priority Data

Jul. 6, 2006 (JP) ..... 2006-187129

(51) Int. Cl.

| | |
|---|---|
| ***B21C 51/00*** | (2006.01) |
| *B21B 37/58* | (2006.01) |
| *B21D 31/00* | (2006.01) |
| *G06F 19/00* | (2006.01) |

(52) U.S. Cl. ..... 72/15.1; 72/14.8; 72/31.1; 72/389.3; 700/175; 700/179

(58) Field of Classification Search ..... 72/14.8, 72/14.9, 15.1, 15.2, 389.3; 700/29, 30, 31, 700/177, 178, 108, 109, 245

See application file for complete search history.

(56) References Cited

U.S. PATENT DOCUMENTS 4,753,099 A * 6/1988 Klingel ..... 72/389.3
4,831,862 A * 5/1989 Ohashi et al. ..... 72/389.3

(Continued)

FOREIGN PATENT DOCUMENTS

JP 63-036925 A 2/1988

(Continued)

OTHER PUBLICATIONS

English language Abstract of JP 2-046920 A (Feb. 16, 1990).

(Continued)

*Primary Examiner* — Dana Ross
*Assistant Examiner* — Lawrence J Averick
(74) *Attorney, Agent, or Firm* — Greenblum & Bernstein, P.L.C.

(57) ABSTRACT

A method for utilizing a bending machine die layout includes designating a die layout of a bending machine, the designated die layout being defined by arrangements of replaceable punches and replaceable dies installed on the bending machine. The method also includes extracting, in the designated die layout, segments in each of which a punch and a die face overlapping to each other to be actually used for one of bending processes, as virtual die stages based on punch attachment positions and punch lengths of the punches, and die attachment positions and die lengths of the dies. The method further includes assigning, by using a sheet metal shape model of a bent product planned to be made by the bending machine, bend lines on the sheet metal shape model corresponding to actual bend lines of the bent product, to the virtual die stages.

11 Claims, 12 Drawing Sheets

U.S. PATENT DOCUMENTS

| | | | | |
|---|---|---|---|---|
| 5,029,462 | A * | 7/1991 | Wakahara et al. | 72/379.2 |
| 5,587,913 | A * | 12/1996 | Abrams et al. | 700/119 |
| 5,761,940 | A * | 6/1998 | Moore et al. | 72/19.4 |
| 5,799,530 | A * | 9/1998 | Nagasawa | 72/389.3 |
| 5,969,973 | A * | 10/1999 | Bourne et al. | 700/165 |
| 5,983,688 | A * | 11/1999 | Anzai et al. | 72/15.1 |
| 6,185,476 | B1 * | 2/2001 | Sakai | 700/182 |
| 6,189,364 | B1 * | 2/2001 | Takada | 72/702 |
| 6,192,297 | B1 * | 2/2001 | Marobin | 700/245 |
| 6,227,022 | B1 * | 5/2001 | Nagasawa | 72/14.8 |
| 6,243,611 | B1 * | 6/2001 | Hazama et al. | 700/97 |
| 6,292,716 | B1 * | 9/2001 | Moore et al. | 700/260 |
| 6,298,700 | B2 * | 10/2001 | Nagasawa | 72/14.8 |
| 6,341,243 | B1 * | 1/2002 | Bourne et al. | 700/165 |
| 6,507,767 | B2 * | 1/2003 | Bourne et al. | 700/165 |
| 6,644,082 | B2 * | 11/2003 | Chebbi | 72/31.11 |
| 6,701,208 | B2 * | 3/2004 | Hwang | 700/165 |
| 6,751,993 | B2 * | 6/2004 | Sekita et al. | 72/31.1 |
| 6,807,835 | B1 * | 10/2004 | Sekita et al. | 72/31.1 |
| 6,823,708 | B1 * | 11/2004 | Okubo | 72/420 |
| 7,040,129 | B2 * | 5/2006 | Koyama et al. | 72/31.11 |
| 7,254,461 | B2 * | 8/2007 | Hosokawa et al. | 700/177 |
| 7,324,868 | B2 * | 1/2008 | Yamazaki et al. | 700/166 |
| 7,440,874 | B2 * | 10/2008 | Durney et al. | 703/1 |
| 7,778,715 | B2 * | 8/2010 | Kirshenbaum et al. | 700/31 |
| 7,822,495 | B2 * | 10/2010 | Nixon et al. | 700/87 |
| 7,966,092 | B2 * | 6/2011 | Fujibayashi et al. | 700/178 |
| 2004/0019402 | A1 * | 1/2004 | Bourne et al. | 700/165 |
| 2006/0162408 | A1 * | 7/2006 | Niwa et al. | 72/31.1 |
| 2009/0100896 | A1 * | 4/2009 | Akami et al. | 72/389.4 |
| 2009/0293576 | A1 * | 12/2009 | Shibata | 72/389.1 |

FOREIGN PATENT DOCUMENTS

| | | | |
|---|---|---|---|
| JP | 2-046920 | A | 2/1990 |
| JP | 9-509618 | A | 9/1997 |
| JP | 2004-160547 | A | 6/2004 |
| WO | 98/01243 | A1 | 1/1998 |

OTHER PUBLICATIONS

English language Abstract of JP 63-036925 A (Feb. 17, 1988).
English language Abstract of JP 2004-160547 A (Jun. 10, 2004).

* cited by examiner

Ol, Or : INTERFERENCE QUANTITY (LEFT AND RIGHT)
Gl, Gr : GAP AMOUNT (LEFT AND RIGHT)
BL : BENDING LENGTH

METHOD AND APPARATUS FOR UTILIZING BENDING MACHINE DIE LAYOUT

TECHNICAL FIELD

The present invention relates to a method and an apparatus for utilizing a layout of a die (punches and dies) for a bending machine.

BACKGROUND ART

Generally, in bending of a sheet such as a sheet metal, multiple die stages are attached to a bending machine such as a press brake so as to create a die layout. Each of the die stages has a punch and a die in a set and is capable of working one or more working parts. While moving between the die stages, an operator performs bending by sandwiching and pressurizing each bending portion (bend line) of a workpiece between the punch and the die in the assigned die stage and plastically deforming the portion.

When the bending can be performed by use of the die layout already attached to the machine or a bending machine having a fixed die layout, the bending is performed without changing the die layout or by adding a die stage required.

In conventional automatic die layout creation processing, a die layout is automatically generated in such a way that a plurality of die stages capable of working are created from the part shape based on a bending order, and then are arranged. The background art as described above is disclosed in the following Published Japanese translation of International Publication for Patent applications.

[Patent Document 1] Patent Brochure of Japanese National Publication of Translated Version (Kohyo) No. Hei 9-509618

DISCLOSURE OF THE INVENTION

Technical Problem

However, in conventional automatic bending order generation processing and die layout creation processing, a die layout which enables bending for one or more parts is newly generated in each case from a part shape based on a bending order. Thus, data generation processing based on a designated die layout, such as (1): performing bending by reusing a die layout already attached to the machine, and (2): performing bending by use of a bending machine having a fixed die layout, both of which are performed in an actual situation, cannot be performed. Thus, setup operation for changing the die layout to a newly generated die layout is required for each case. As a result, there is a problem that reduction in the setup operation cannot be achieved.

The present invention is made to solve the foregoing problems, and it is an object of the present invention to provide a method and an apparatus for utilizing a layout of a die (punches and dies) for a bending machine (a bending machine die layout), which can achieve reduction in setup operation by utilizing the bending machine die layout.

Technical Solution

A first aspect of the present invention is a method for utilizing a bending machine die layout, the method including the steps of: designating a die layout of a bending machine; extracting a region, in the designated die layout, where a punch and a die face each other, as a virtual die stage; and assigning the extracted virtual die stage to each bend line by using a sheet metal shape model of a working part A second aspect of the present invention is the method for utilizing a bending machine die layout, according to the first aspect, further including the step of creating a list of the assigned virtual die stages in a bending order.

A third aspect of the present invention is the method for utilizing a bending machine die layout, according to one of the first and second aspects, wherein, when a plurality of the virtual die stages are assignable to a part of bending processes required for the working part, one having a better material handling efficiency among the virtual die stages is assigned.

A fourth aspect of the present invention is the method for utilizing a bending machine die layout, according to any one of the first to third aspects, further including the step of, when any of the virtual die stages is not assignable to a part of bending processes required for the working part, additionally generating a new virtual die stage suitable for the part of the bending processes to which the virtual die stages are not assignable.

A fifth aspect of the present invention is a bending workability determination apparatus for determining bending workability by utilizing a bending machine die layout and using a sheet metal shape model, the apparatus including: means (module) for designating a die layout that is a die condition for determining whether or not the bending method is suitable; means (module) for extracting one virtual die stage related to a single bending process in the designated die layout; means (module) for specifying a bending process to be subjected to determination of workability; and means (module) for determining workability of bending is by using the extracted virtual die stage as the die condition in the specified bending process. When a result of the determination of bending workability is positive, a bending position in the die layout is calculated.

A sixth aspect of the present invention is the bending workability determination apparatus according to the fifth aspect, wherein a portion, in the die layout, where a punch and a die face each other, is extracted as a virtual die stage.

A seventh aspect of the present invention is a bending order generation apparatus for generating a bending order by utilizing a bending machine die layout and using a sheet metal shape model, the apparatus including: means (module) for inputting a sheet metal shape model for generating a bending order; die layout setting means (module) for designating a die layout as one of conditions for generating the bending order; means (module) for extracting one virtual die stage related to a single bending process in the designated die layout; bending search means (module) for searching for the bending order by extracting a bend line of the sheet metal shape model; and bending workability determination means (module) for determining, by using the virtual die stage as a die condition, bending workability at a specific node during the searching by the bending search module. When the search for the bending order is successful, the bending order including a bending position is outputted.

An eighth aspect of the present invention is the bending order generation apparatus according to the seventh aspect, wherein a portion, in the die layout, where a punch and a die face each other, is extracted as a virtual die stage.

A ninth aspect of the present invention is a bending data adaptation apparatus for converting bending data into bending data adapted to designated die setup, the apparatus including: means (module) for inputting a sheet metal shape model and bending data corresponding to the sheet metal shape model; means (module) for specifying a suitable die layout; means (module) for extracting one virtual die stage related to a single bending process in the designated die layout; and means (module) for searching for a suitable one of the virtual die stages by determining bending workability in each of processes according to a bending order specified by the bending data. When a virtual die stage suitable for all the processes is found, bending data at a bending position in the die layout is outputted.

A tenth aspect of the present invention is the bending data adaptation apparatus according to the ninth aspect, wherein a portion, in the die layout, where a punch and a die face each other, is extracted as a virtual die stage.

As described above, according to the first to tenth aspects of the present invention, the method includes the steps of: designating a bending machine die layout; extracting a region, in the designated die layout, where a punch and a die face each other, as a virtual die stage; and assigning the extracted virtual die stage to each bend line using a sheet metal shape model of working parts. Accordingly, the bending machine die layout can be utilized and thus reduction in setup operation can be achieved.

To be more specific, it is possible to automatically determine whether or not working can be performed by use of the die layout already attached to the machine. Moreover, reduction in setup operation can be achieved by reusing the die layout already attached to the machine.

BRIEF DESCRIPTION OF THE ACCOMPANYING DRAWINGS

FIG. 5 (*a*) is a schematic explanatory view showing a clearance and FIG. 5 (*b*) is a schematic explanatory view showing the case where the inside R is smaller than a thickness.

FIG. 9 (*a*) shows a mode having a sufficient punch length, FIG. 9 (*b*) shows a mode having a sufficient die length and FIG. 9 (*c*) shows a mode having a punch and a die set in a set.

BEST MODE FOR CARRYING OUT THE INVENTION

First, an outline of the present invention will be described. The present invention is a method and an apparatus for generating or optimizing bending data and includes an algorithm used for a program and the method. Specifically, the present invention designates, in creation or optimization of the bending data, a die layout to be used for the processing and generates or optimizes the bending data according to the designated die layout.

Generally, for a part having N bends (quantity of bend lines is N), N! different kinds of bending orders are conceivable. Moreover, one bending order is obtained after all of the N bends can be sequentially bent. In the case of searching for this bending order, the present invention designates a layout of a die (punches and dies) where the die layout is used for determining workability at each node in the middle of searching.

However, there is one or more stages of a die (punches and dies) in one of the die layout, and each of the die stages usually has different die numbers (each of which specifies a die cross-sectional shape) and different die lengths. Moreover, there is also a case where the die stages are partially shared. Thus, the workability cannot be determined unless it is specified a position in the designated die layout at which a workpiece should be bent, the die number, length and the like involved in the bending.

Therefore, in the present invention, in order to specify the position, a portion (a portion to be actually bent), in the designated die layout, where a punch and a die face each other, is set as a virtual die stage. Moreover, the workability is determined by use of the virtual die stage and a bending position is specified.

Moreover, in the present invention, in the case where the bending data is optimized so as to adapt to a die setup situation of a working machine, die conditions and the bending position are changed based on the designated die layout while the bending order of each bending data is not changed. Thus, the bending data is recreated as working data adapted to the designated die layout. Furthermore, in order to specify a position in the die layout at which the workpiece is to be bent, the workability is determined by use of the virtual die stage and the bending position is specified.

As a result of the processes described above, the present invention can solve a problem of an increasing number of processes for changing the setup in generation of the bending data including the bending order based on a parts model. Specifically, the problem has heretofore been caused when the bending order is determined and a different die layout dependent on an algorithm is generated.

Moreover, in execution of the bending, the number of setup processes can be reduced by adapting the already created working data to the die setup situation of the current working machine.

With reference to the drawings, an embodiment of the present invention will be described.

Figure 1:
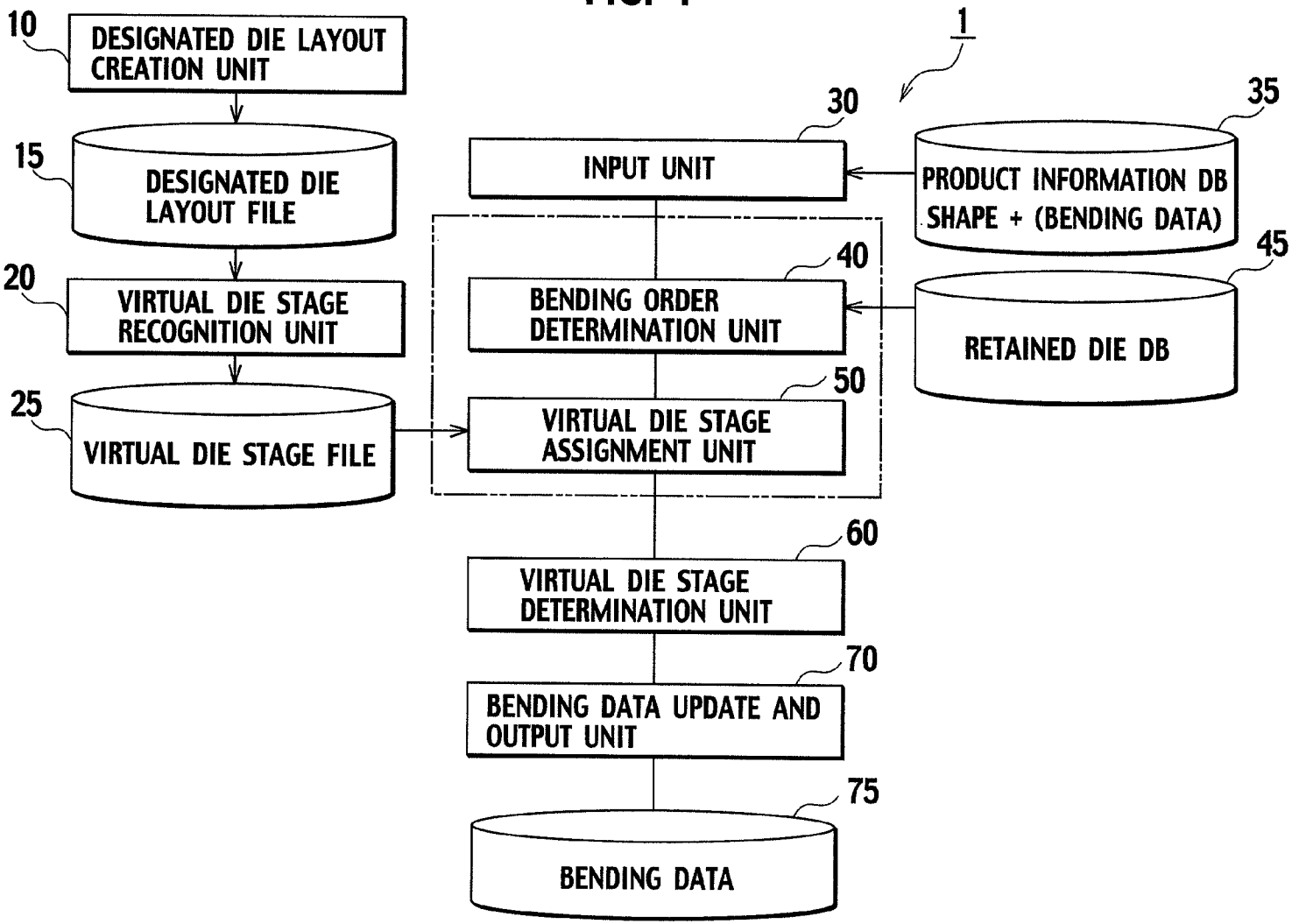
FIG. 1 is a schematic block diagram showing an embodiment of an apparatus for utilizing a bending machine die layout according to the present invention.

FIG. 1 is a schematic block diagram showing an embodiment of an apparatus for utilizing a bending machine die layout according to the present invention. The apparatus 1 for utilizing a bending machine die layout includes a designated die layout creation unit (module) 10, a designated die layout file (module) 15, a virtual die stage recognition unit (module) 20, a virtual die stage file (module) 25, an input unit (module) 30, a product information DB (module) 35, a bending order determination unit (module) 40, a retained die DB (module) 45, a virtual die stage assignment unit (module) 50, a virtual die stage determination unit (module) 60 and a bending data update and output unit (module) 70.

The designated die layout creation unit 10 creates and stores the designated die layout file 15 by manually instructing die layout data on a creation screen.

A designated die layout can be retrieved from outside. For example, a fixed die layout (one used for a bending machine operated with a fixed die layout) which is stored in a server can be retrieved. Moreover, a die layout currently attached to the bending machine can be acquired through a network or the like. Furthermore, when a die layout to be used in a next bending schedule is created based on a previous bending schedule, a die layout used in the previous bending schedule can be used.

In the designated die layout file 15, information about the die layout is stored. The information about the die layout includes a die number, a die length, an attachment direction, an attachment position, a division length and the like.

The virtual die stage recognition unit 20 recognizes a virtual die stage by regarding a portion, in the designated die layout, where a punch and a die overlap each other as one stage (virtual die stage).

Figure 2:
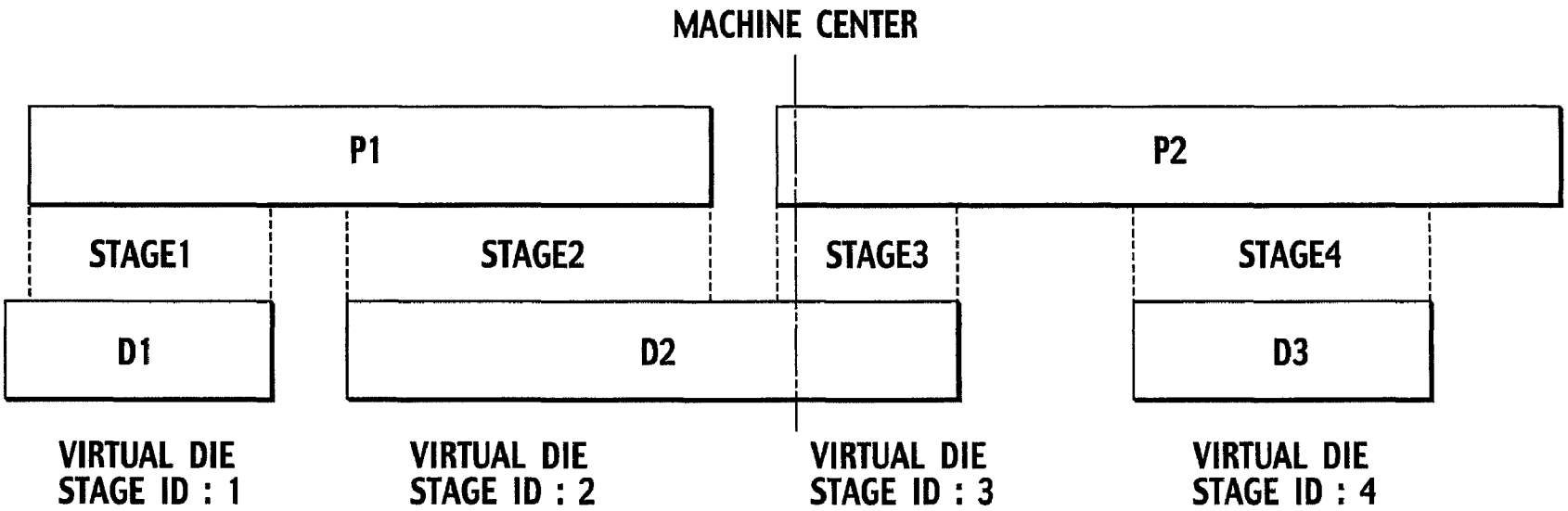
FIG. 2 is a schematic explanatory view showing a relationship between a designated die layout and virtual die stages.

FIG. 2 is a schematic explanatory view showing a relationship between a designated die layout and virtual die stages.

In the case of the designated die layout shown in FIG. 2, it is considered that there are the following four virtual die stages. Specifically, there are STAGE 1: (P1, D1), STAGE 2: (P1, D2), STAGE 3: (P2, D2) and STAGE 4: (P2, D3). A length of each of the virtual die stages is set to be equal to a portion where a punch and a die overlap each other. Moreover, a virtual die stage ID is assigned to each of the virtual die stages.

Moreover, the virtual die stage recognition unit 20 creates and stores the virtual die stage file 25.

The input unit 30 receives data from a sheet metal CAD system and refers to data from the product information DB 35. The product information DB 35 stores a shape of a product and bending data. Specifically, the product information DB 35 stores data such as a thickness and a material of the product, development elevation data and bending attributes (a bending angle, an inside R and an extension).

The bending order determination unit 40 determines a bending order based on the data from the input unit 30 and data from the retained die DB 45. The retained die DB 45 stores, for each die number, information about a die retained. Moreover, die information includes information such as the die number, a shape, a division length and the number of dies retained for each division length.

Thus, the bending order determination unit 40 uses shape information included in the die information and product information to generate an internal model, and generates the bending order by selecting a suitable virtual die stage while checking interference.

Specifically, the bending order determination unit 40 determines the bending order that sets a working order of a plurality of bend lines included in the shape information on the product. A minimum condition to be met is that all bend lines included in the product are workable.

Thereafter, at each node in the middle of searching for the bending order, the virtual die stage assignment unit 50 sequentially assigns the bend lines to the virtual die stages in the virtual die stage file 25. At the same time, interference is checked at the node by using part shape model, the designated die layout file 15 and a designated die layout model generated by use of a die shape of a corresponding die number stored in the retained die DB 45. Thus, a virtual die stage list is generated by extracting the virtual die stage suitable for the bend line at the node.

For generation of the bending order, a predetermined bending order search logic is used. Moreover, during generation of the bending order, information on gap values (distances from left and right ends of the bend line to an interference between the die and parts before and after bending) at each node is also generated.

The virtual die stage assignment unit 50 assigns the virtual die stage to the bend line. Specifically, the virtual die stage assignment unit 50 includes (1) a unit for calculating a gap value and an interference quantity, (2) an assignment checking unit using a minimum flange, pressure resistance, a die length and the like, (3) a bending position offset calculation unit, (4) an interference checking unit, (5) a unit for calculating a die length and an attachment position of an additional die stage, (6) an assigned virtual die stage list processing unit, and the like.

First, the assignment checking unit will be described. When it is checked, at each node during searching for the bending order, to which virtual die stage each bend line is assignable, the following checks are performed, including: a minimum flange length check for checking a relationship between a flange length and a V width of the die; a pressure resistance check for checking a relationship between pressure resistance of the die and an applied pressure required for bending; and a die length check for checking a relationship between a bending length and a length of the virtual die stage. Accordingly, those not meeting conditions are removed from candidates for the virtual die stage to be assigned.

The following are the conditions for the die length check.

Condition 1: there is no interference at least on either side of the bend line, and the virtual die stage length≧the bending length−A is satisfied. Note, however, that A is a margin value, which is set outside as a parameter.

Condition 2: there are interferences on both sides of the bend line, and a normalized die length≦the virtual die stage length≦an inside dimension−ST is satisfied (note, however, that ST is a clearance value, which is arbitrarily obtained. The same goes for the following).

Note that a method for calculating the normalized die length will be described later. Refer to the description for the method.

Figure 3:
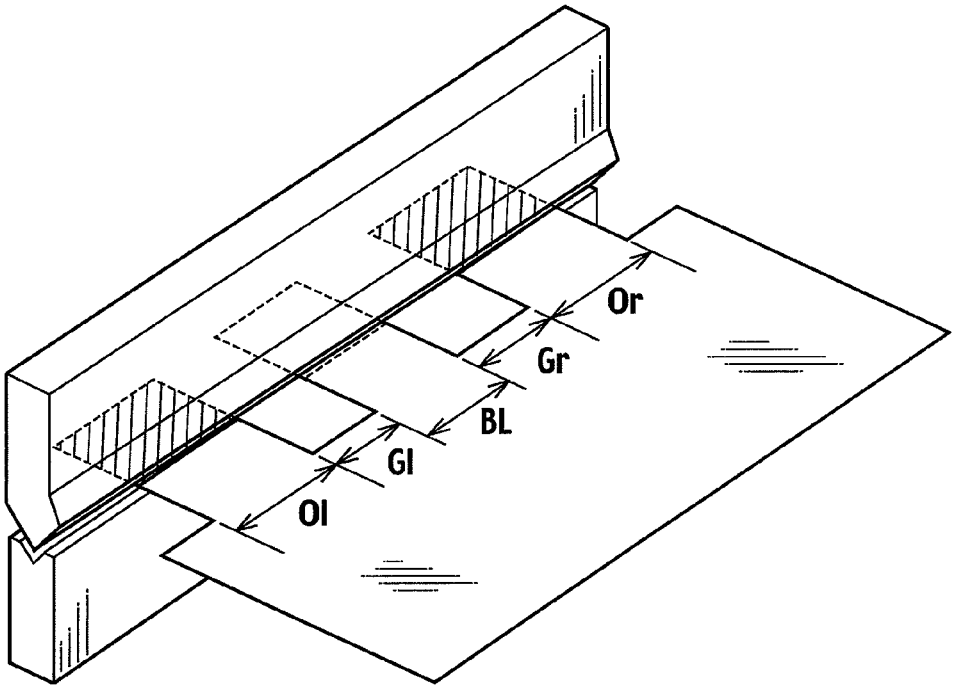
FIG. 3 is a schematic explanatory view showing calculation of a gap value and an interference quantity.

Moreover, with reference to FIG. 3, calculation of a gap value and an interference quantity will be described. Here, a gap amount and an interference quantity for a part shape at each node during searching for the bending order are calculated. The gap amount represents a distance from an end of the bend line to an obstacle. Specifically, as shown in FIG. 3, assuming that Ol and Or are left and right interference quantities, Gl and Gr are left and right gap amounts and BL is a bending length, hatched portions interfere with the die after bending. Specifically, information on gap values (distances from left and right ends of the bend line to an interference between the die and parts before and after bending) in each process is also generated.

Figure 4:
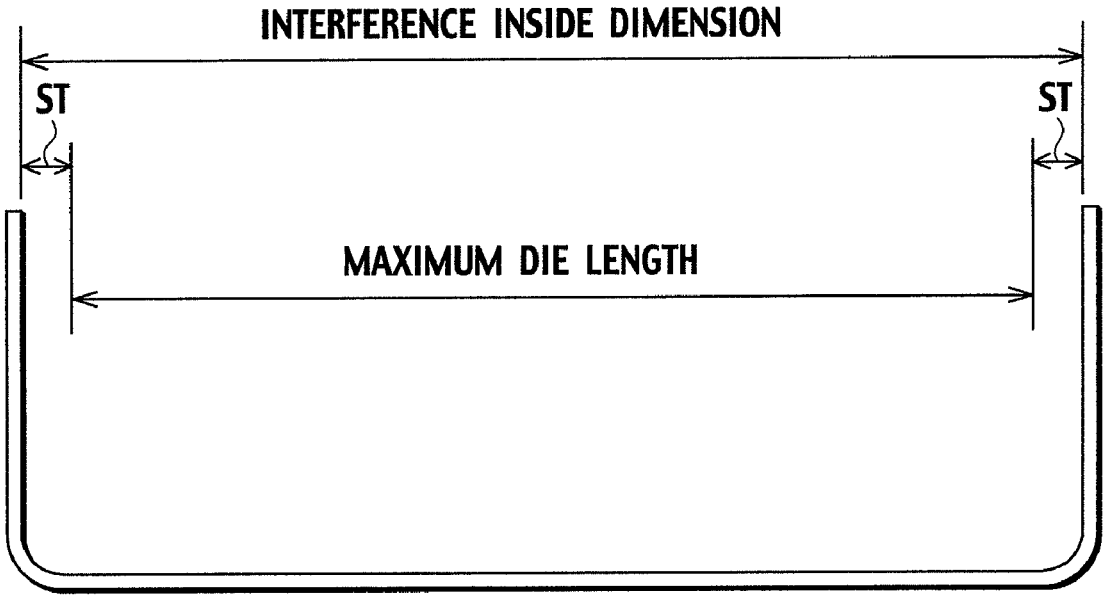
FIG. 4 is a schematic explanatory view showing die length calculation taking into consideration the gap value and an inside R.

Moreover, with reference to FIG. 4, the method for calculating the normalized die length will be described. A basic die length calculation method is as follows.

A. When there is no interference on both sides of a bend line to be a target, the die length is set to be a minimum length longer than the bend line and divisible by 5.

B. When there is an interference on one side of a bend line to be a target, the die length is set to be a minimum length longer than the bend line and divisible by 5.

C. When there are interferences on both sides of a bend line to be a target, the die length is set to be a value obtained by multiplying a quotient by 5, the quotient being obtained when a length obtained by subtracting a clearance (ST) from the interference inside dimension (the bending length+left and right gap values) is divided by 5.

Figure 5:
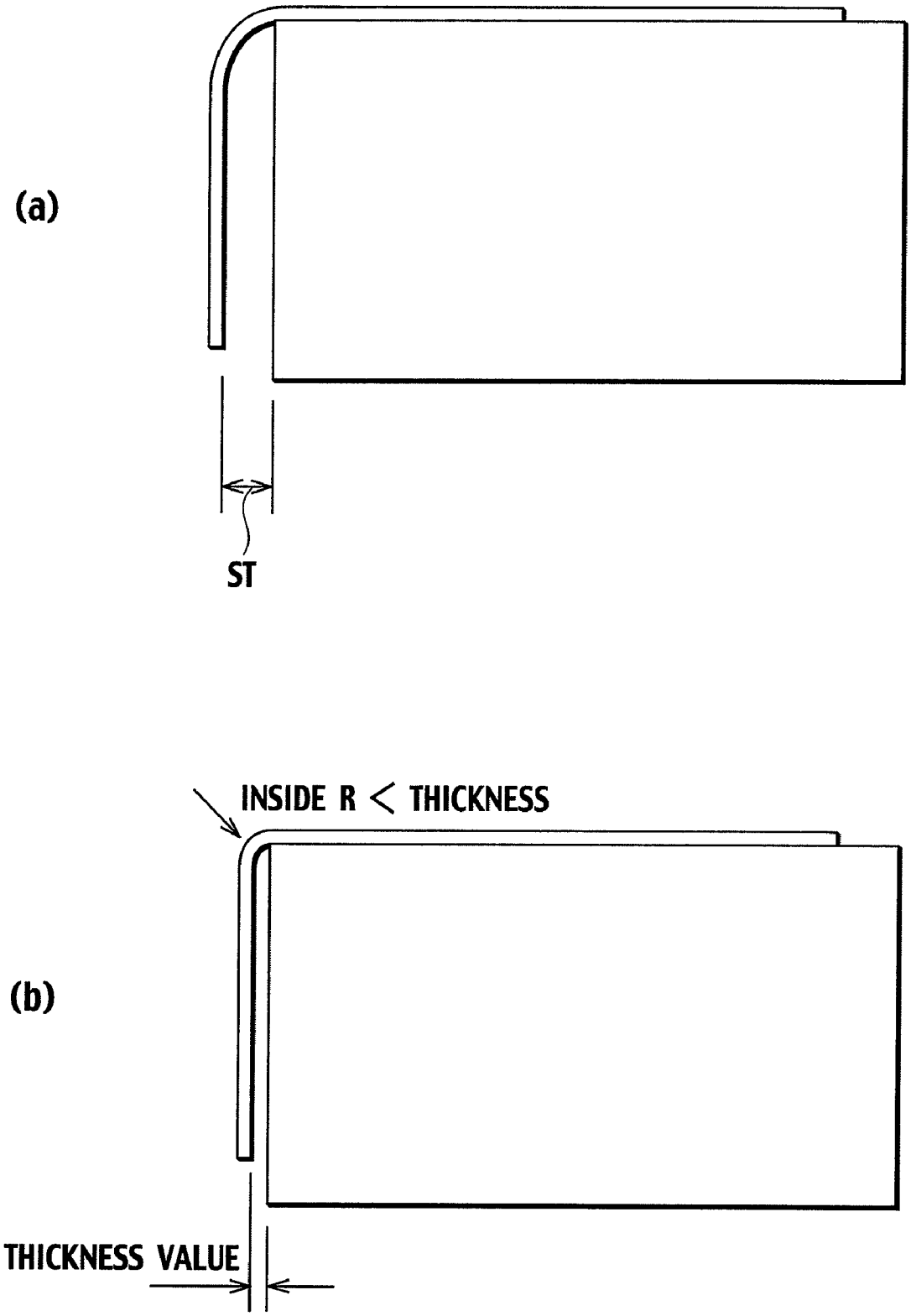
FIG. 5 are schematic explanatory views showing bending position offset calculation.

Moreover, with reference to FIG. 5, bending position offset calculation will be described. The bending position offset calculation is as follows.

A. When there is no interference on either side of a part bend line for the punch and the die, a central joint position with respect to the virtual die stage length is set to be a bending position.

B. When there is an interference on either side of a part bend line for the punch and the die, a position away from the interference by the clearance value (ST) is set to be a bending position.

Moreover, the interference checking unit will be described. At the offset position of the above bending position with respect to the virtual die stage, interferences among the parts (before and after bending), the machine and a model of the die are checked. The model of the die is set to be a model of a designated die layout (not a model of the virtual die stage).

Moreover, processing of adding an additional virtual die stage will be described. When it is determined that the bend line cannot be assigned to any of the virtual die stages, an additional virtual die stage is added to the designated die layout. A die length of the additional virtual die stage is calculated from a bending length of a bending process determined to be unassignable and the left and right gap values by performing normal die length calculation processing using the current logic (see the above description of the die length calculation with consideration of the gap values and the inside R).

Furthermore, the assigned virtual die stage list processing unit will be described. As will be described later, when the bend line is determined to be assignable to the virtual die stage since there is no error in the checking during the searching for the bending order, the ID of the virtual die stage that is assignable to the bend line at the current node is added to the assigned virtual die stage list. Moreover, a format of the list is as follows. The list includes the virtual die stage ID and the bending position offset, as one set, for each bend line number.

```
Assigned Virtual Die Stage List [Bend line Number]
    = ((Virtual Die Stage ID1          Bending Position Offset)
       (Virtual Die Stage ID2          Bending Position Offset)
                          .....
       )
```

The virtual die stage determination unit 60 selects one of the multiple virtual die stages assigned to the bend lines by the virtual die stage assignment unit 50 and determines the selected one as the virtual die stage of the bend line.

Here, virtual die stage determination processing will be described.

When there are virtual die stage IDs that are assignable to all processes in the bending order and the assigned virtual die stage list, the virtual die stage whose center is closest to the center of the machine is assigned to all the processes. This is obtained as a final result.

When there are no such virtual die stages, combination candidates of the virtual die stage IDs are generated from the bending order and the assigned virtual die stage list.

From the combination candidates described above, a combination that has the minimum movement distance of the bending position from the first process to the final process is extracted. This is obtained as a final result.

Now, description will be given by taking the designated die layout shown in FIG. 2 as an example.

Assuming that there are three bending processes, considered is a case where the respective IDs in the virtual die stage list are as follows.

Virtual die Stage IDs Assignable to First Process: ID1, ID2, ID3, ID4

Virtual die Stage IDs Assignable to Second Process: ID1, ID2, ID3

Virtual die Stage IDs Assignable to Third Process: ID2, ID3

In this case, while the virtual die stage IDs that are assignable to all the processes are ID2 and ID3, the one whose center is closest to the center of the machine is ID3. Thus, as a final result, all the processes are assigned to the virtual die stage ID3.

Next, considered is a case where there are no virtual die stages that are assignable to all the processes. In this case, assignment in which a movement distance is at minimum is considered.

Here, description will be given by taking the designated die layout shown in FIG. 2 as an example.

Assuming that there are three bending processes, considered is a case where the respective IDs in the virtual die stage list are as follows.

Virtual die Stage ID Assignable to First Process: ID1

Virtual die Stage IDs Assignable to Second Process: ID3, ID4

Virtual die Stage ID Assignable to Third Process: ID2

In this case, the following combination candidates of assignable virtual die stage IDs are conceivable.

Candidate 1: First Process (ID1)-Second Process (ID3)-Third Process (ID2)

Candidate 2: First Process (ID1)-Second Process (ID4)-Third Process (ID2)

Between the above combination candidates, Candidate 1 has the smallest movement distance. Thus, assignment of Candidate 1 is obtained as a final result.

The bending data update and output unit 70 outputs bending data 75 for controlling the bending machine by use of the bending order determined by the bending order determination unit 40 and the virtual die stage finally determined by the virtual die stage determination unit 60. The bending data update and output unit 70 also outputs updated die layout data when a die stage is added.

With reference to flowcharts, processing executed by the respective units will be described below.

Figure 6:
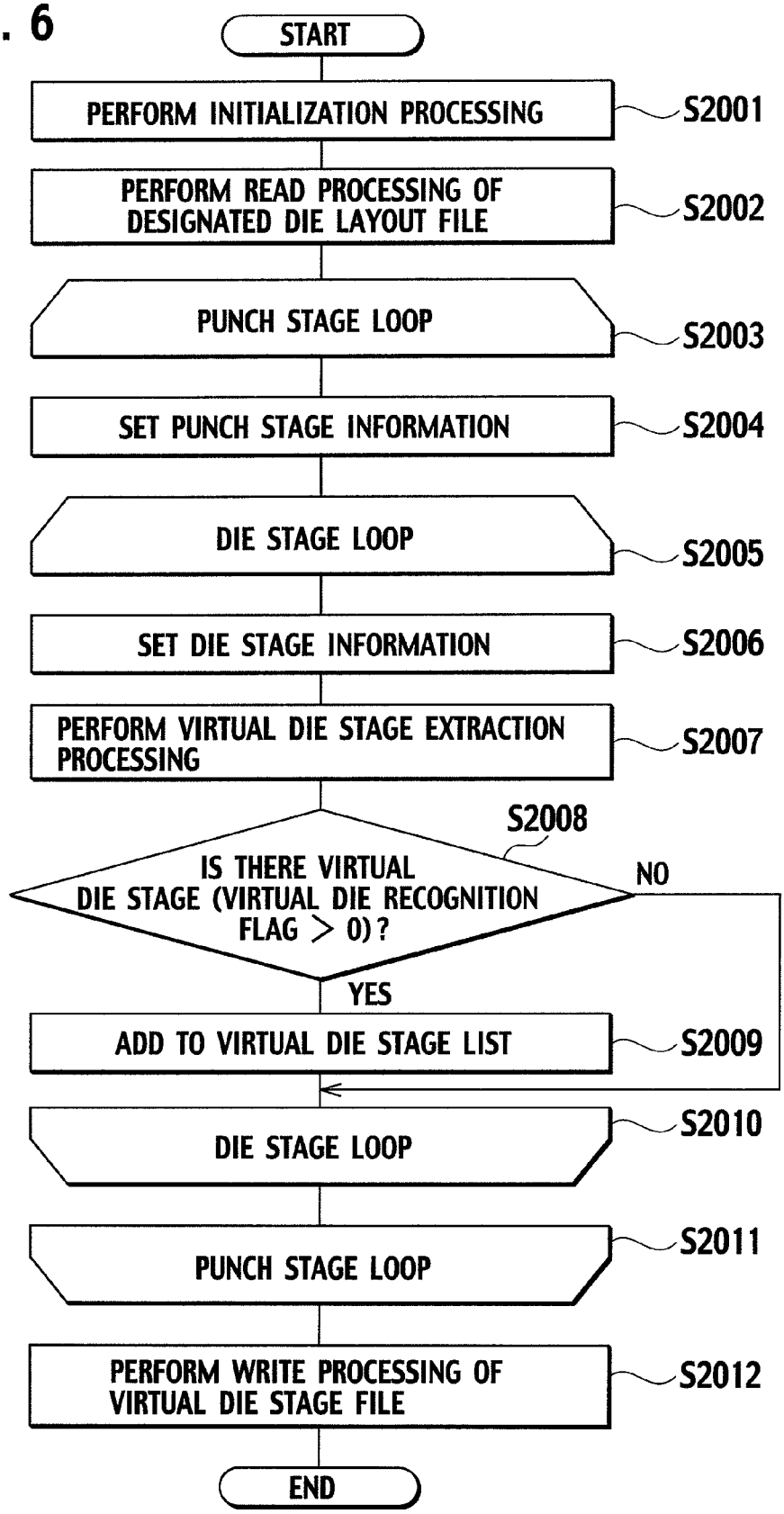
FIG. 6 is a flowchart schematically showing processing executed by a virtual die stage recognition unit.

FIG. 6 is a flowchart schematically showing processing executed by the virtual die stage recognition unit 20.

As shown in FIG. 6, first, initialization processing is performed (Step S2001). In the initialization processing, the following processes are performed, including: initialization of virtual die stage list information; setting a virtual die stage recognition flag to 0; setting a virtual die stage ID to 0; and initialization of designated die layout information.

Next, designated die layout file read processing is performed (Step S2002). In the designated die layout file read processing, acquired is information on a die number, a die length, an attachment direction and an attachment position for each punch stage (P1, P2, . . . Pn) and each die stage (D1, D2, D3, . . . Dn). Note that an attachment position reference position (0, 0) of the punch and the die is set to a left end of the machine.

Next, processing from Step S2003 to Step S2011 is set as a punch stage loop.

Here, first, punch stage information setting processing is performed (Step S2004). In the punch stage information setting processing, a punch attachment position (Ploc) and a punch length (Plen) are set.

Next, processing from Step S2005 to Step S2010 is set as a die stage loop.

Here, first, die stage information setting processing is performed (Step S2006). In the die stage information setting processing, a die attachment position (Dloc) and a die length (Dlen) are set.

Next, virtual die stage extraction processing is performed (Step S2007). In the virtual die stage extraction processing, a virtual die stage is extracted based on a positional relationship among Ploc, Plen, Dloc and Dlen. The virtual die stage extraction processing will be described later.

Next, it is determined whether or not there is a virtual die stage (virtual die recognition flag>0) (Step S2008). When there is a virtual die stage (virtual die recognition flag>0), virtual die stage list addition processing is performed (Step S2009). In the virtual die stage list addition processing, information on the virtual die stage extracted is added to a virtual die stage list. The virtual die stage list addition processing will be described later.

Figure 7:
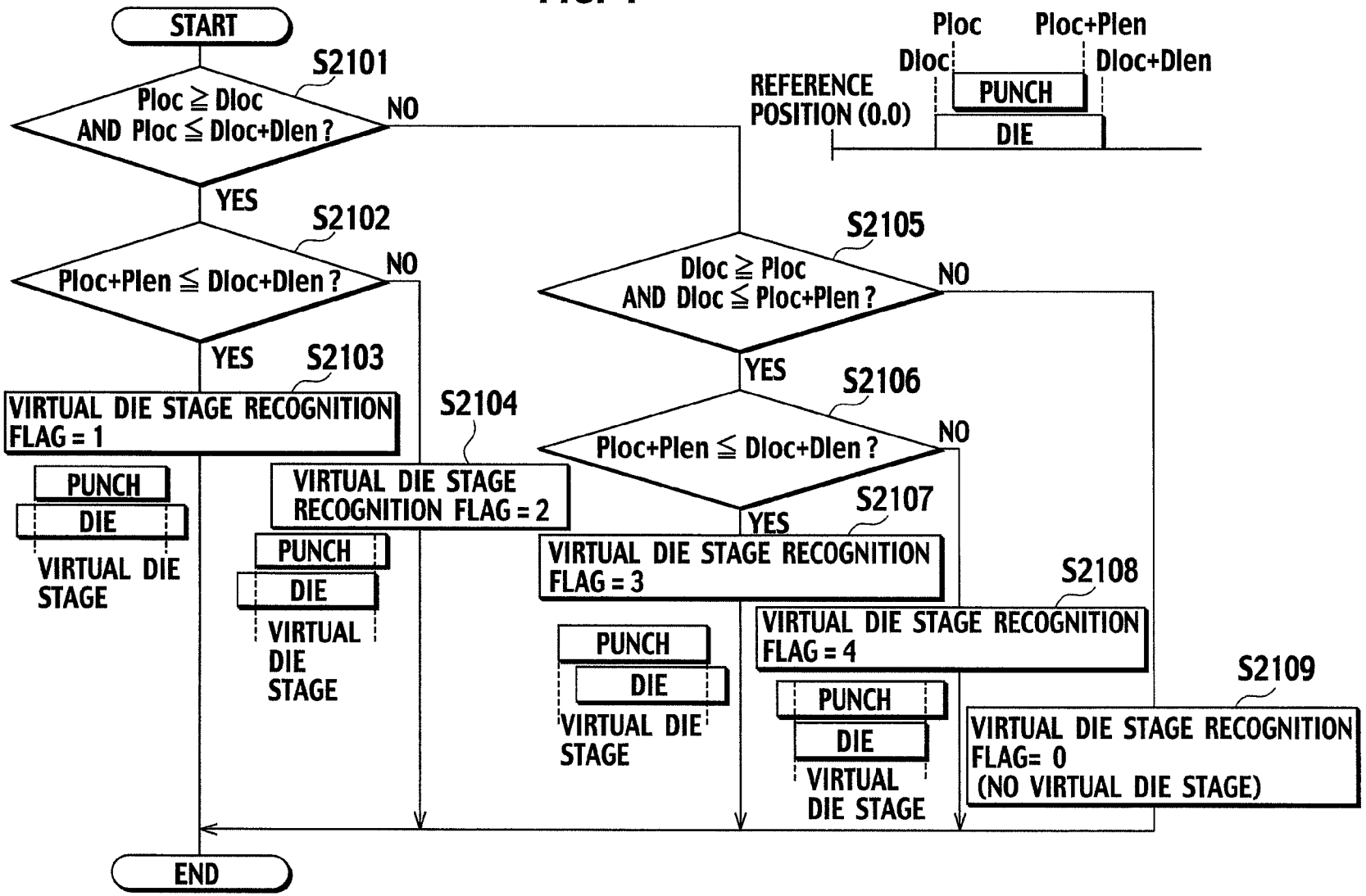
FIG. 7 is a flowchart schematically showing virtual die stage extraction processing.

FIG. 7 is a flowchart schematically showing the virtual die stage extraction processing.

As shown in FIG. 7, in the virtual die stage extraction processing, first, it is determined whether or not Ploc≧Dloc and Ploc≦Dloc+Dlen are satisfied (Step S2101).

If the result of the determination in Step S2101 is YES, then it is determined whether or not Ploc+Plen≦Dloc+Dlen is satisfied (Step S2102).

If the result of the determination in Step S2102 is YES, the virtual die stage recognition flag is set to 1 (Step S2103).

On the other hand, if the result of the determination in Step S2102 is NO, the virtual die stage recognition flag is set to 2 (Step S2104).

Meanwhile, if the result of the determination in Step S2101 is NO, then it is determined whether or not Dloc≧Ploc and Dloc≦Ploc+Plen are satisfied (Step S2105).

If the result of the determination in Step S2105 is YES, then it is determined whether or not Ploc+Plen≦Dloc+Dlen is satisfied (Step S2106).

If the result of the determination in Step S2106 is YES, the virtual die stage recognition flag is set to 3 (Step S2107).

On the other hand, if the result of the determination in Step S2106 is NO, the virtual die stage recognition flag is set to 4 (Step S2108).

Furthermore, if the result of the determination in Step S2105 is NO, the virtual die stage recognition flag is set to 0 (no virtual die stage) (Step S2109).

Figure 8:
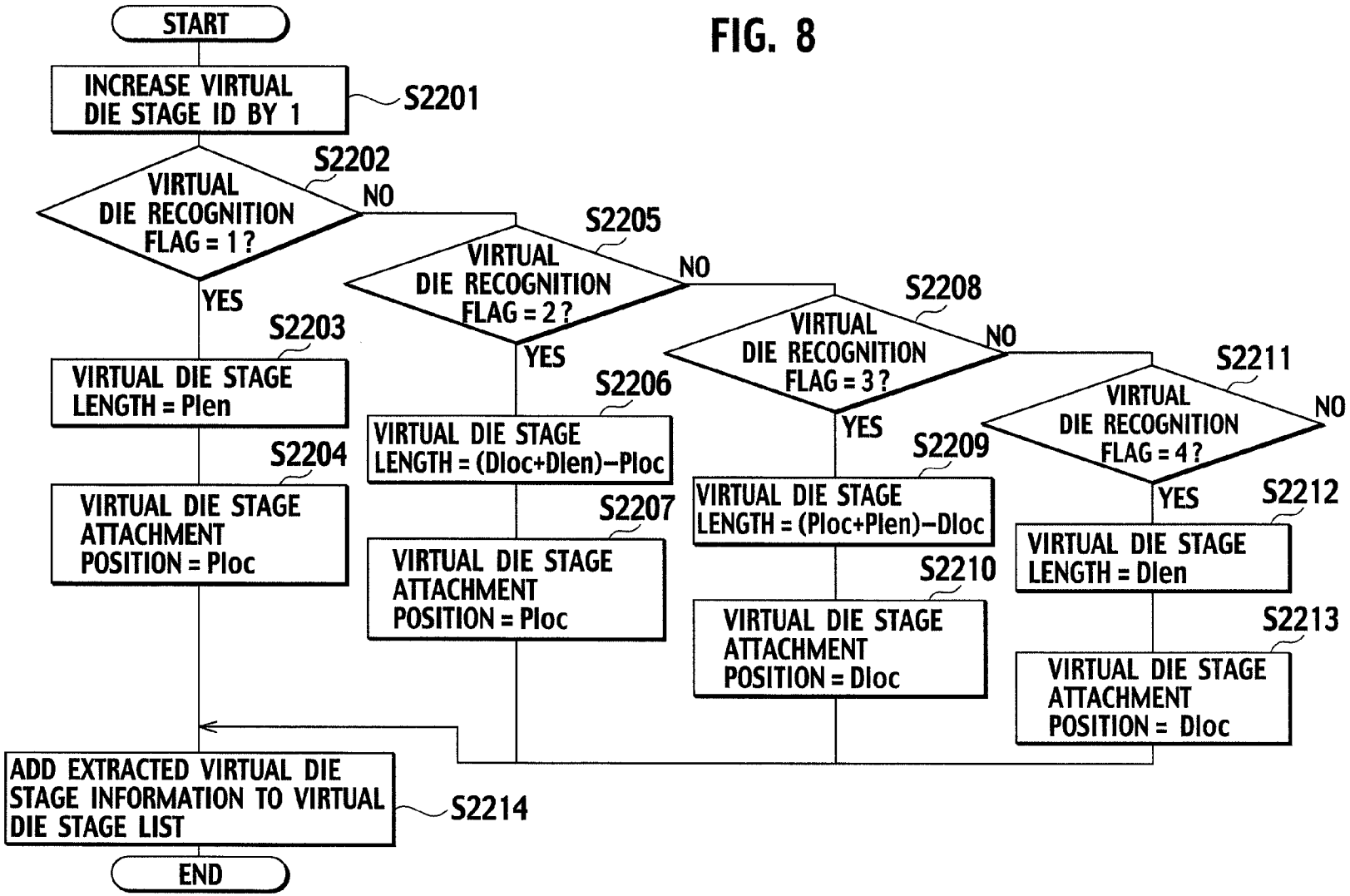
FIG. 8 is a flowchart schematically showing virtual die stage list addition processing.

FIG. 8 is a flowchart schematically showing the virtual die stage list addition processing.

As shown in FIG. 8, in the virtual die stage list addition processing, first, a virtual die stage ID is increased by 1 (Step S2201).

Next, it is determined whether or not a virtual die recognition flag is 1 (Step S2202).

If the result of the determination in Step S2202 is YES, the virtual die stage length is set to be Plen (Step S2203) and the virtual die stage attachment position is set to be Ploc (Step S2204).

On the other hand, if the result of the determination in Step S2202 is NO, it is determined whether or not the virtual die recognition flag is 2 (Step S2205).

If the result of the determination in Step S2205 is YES, the virtual die stage length is set to be (Dloc+Dlen)−Ploc (Step S2206) and the virtual die stage attachment position is set to be Ploc (Step S2207).

Meanwhile, if the result of the determination in Step S2205 is NO, it is determined whether or not the virtual die recognition flag is 3 (Step S2208).

If the result of the determination in Step S2208 is YES, the virtual die stage length is set to be (Ploc+Plen)−Dloc (Step S2209) and the virtual die stage attachment position is set to be Dloc (Step S2210).

Furthermore, if the result of the determination in Step S2208 is NO, it is determined whether or not the virtual die recognition flag is 4 (Step S2211).

If the result of the determination in Step S2211 is YES, the virtual die stage length is set to be Dlen (Step S2212) and the virtual die stage attachment position is set to be Dloc (Step S2213).

In either case of Steps S2204, S2207, S2210 and S2213 described above, the extracted virtual die stage information is finally added to the virtual die stage list (Step S2214).

Here, a virtual die stage list format will be described.

In the virtual die stage list, the virtual die stage information (virtual die stage ID, virtual die stage length, virtual die stage attachment position, die number for a punch, die number for a die, punch attachment direction, die attachment direction) is listed in the following format.

```
Virtual Die Stage List = ((Virtual Die Stage Information on ID1)
    (Virtual die Stage Information on ID2)
                    .....
    )
```

The above description was given of the processing of specifying, as the virtual die stage, a portion contributing to bending by cooperative action between the punch and the die in the designated die layout.

However, in order to simplify the effort of creating the die layout data or the processing, it is regarded that there is an opposing die or punch for a punch or die to be a reference in the designated die layout. Thus, the virtual die stage can be specified by use of information on either one to be a reference.

Figure 9:
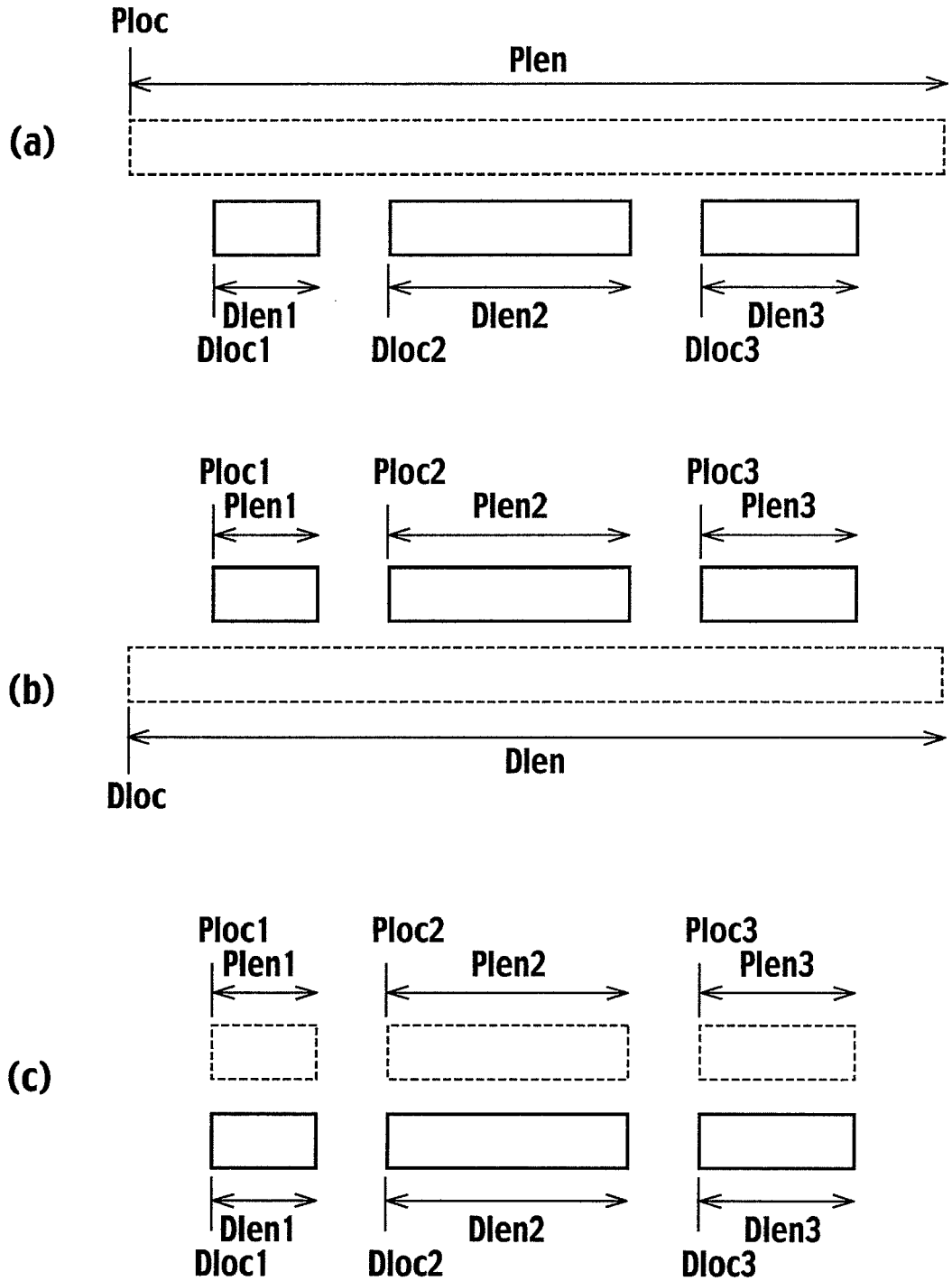
FIG. 9 are schematic explanatory views showing processing of specifying the virtual die stage.

With reference to FIG. 9, concrete description will be given below.

FIG. 9 (*a*) shows a case on the premise that a punch length is sufficient and there is always a punch facing respective dies or a case where such a situation can be confirmed by prior checking. In this case, the virtual die stage can be extracted by use of information on positions and lengths of the dies in the designated die layout without referring to punch information and the extracted virtual die stage can be added to the virtual die stage list.

FIG. 9 (*b*) shows a case on the premise that, in contrast to FIG. 9 (*a*), a die length is sufficient and there is always a die facing respective punches or a case where such a situation can be confirmed by prior checking. In this case, the virtual die stage can be extracted by use of information on positions and lengths of the punches in the designated die layout without referring to die information and the extracted virtual die stage can be added to the virtual die stage list.

FIG. 9 (*c*) shows a case where punches and dies are set in sets or a case where such a situation can be confirmed by prior checking. In this case, since positions and lengths of the respective punches and dies are equal, the virtual die stage can be extracted by use of information only on the punches or the dies and the extracted virtual die stage can be added to the virtual die stage list.

Figure 10:
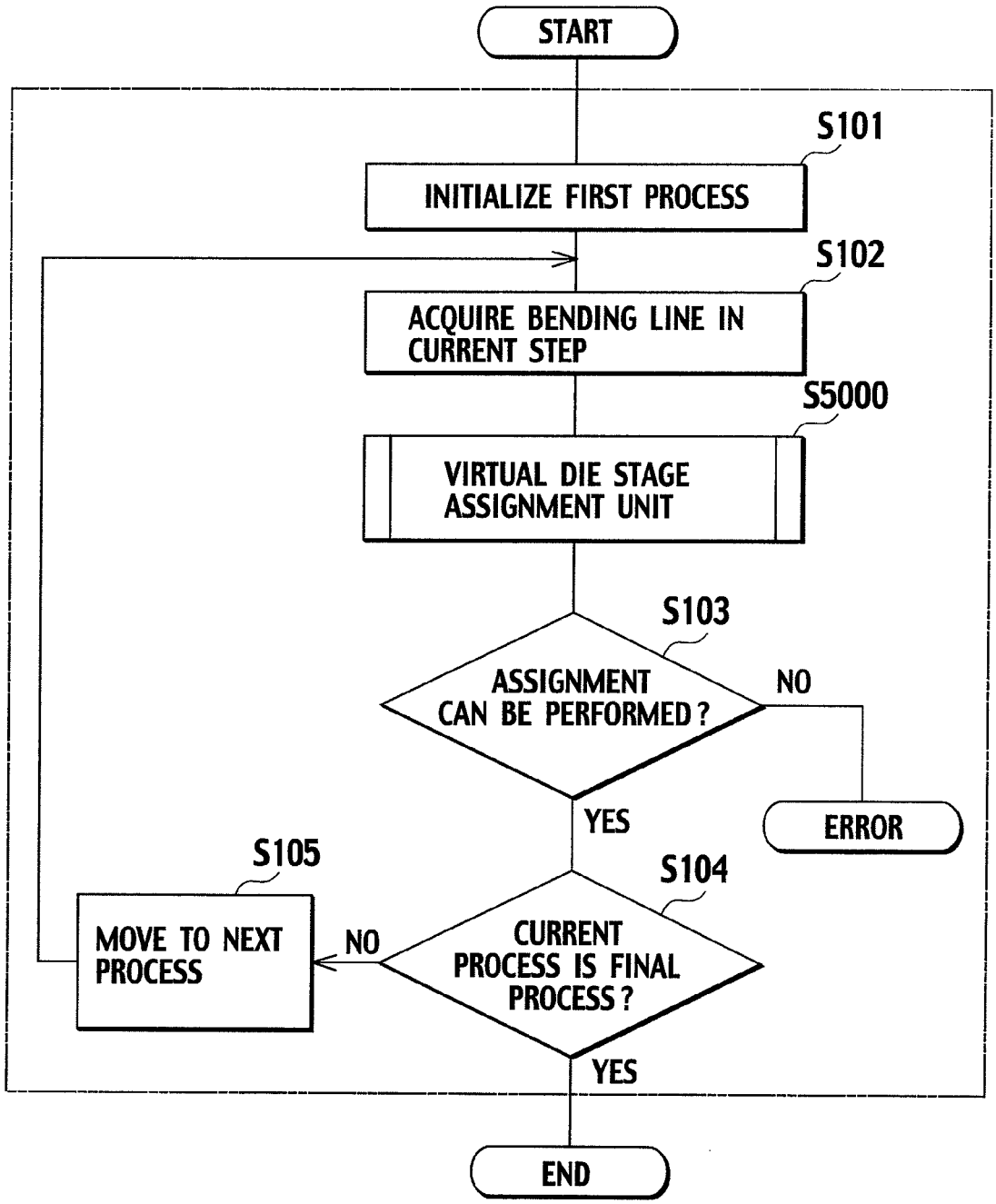
FIG. 10 is a flowchart schematically showing an example of virtual die stage assignment processing based on data having a bending order determined.

FIG. 10 is a flowchart schematically showing an example of virtual die stage assignment processing based on data having a bending order determined (details of a portion surrounded by a two-dot chain line in FIG. 1 correspond to a portion surrounded by a two-dot chain line in FIG. 10, and the processing shown in FIG. 1 is performed as a whole).

As shown in FIG. 10, first, a first process is initialized (Step S101). Next, a bend line in a current process is acquired (Step S1102). Thereafter, assignment processing is performed by the virtual die stage assignment unit (Step S5000). Subsequently, it is determined whether or not assignment can be performed (Step S103). If the assignment can be performed, it is determined whether or not the current process is a final process (Step S104).

If the current process is not the final process, the processing moves to a next step (Step S105) and returns to Step S102. On the other hand, if the current process is the final process, the processing is terminated.

Moreover, if it is determined in Step S103 that the assignment cannot be performed, then this is regarded as an error.

Through the above processing, it is possible to select a product that is workable by use of a die (designated die layout) already set up in the bending machine. Moreover, since bending data adapted to the setup is outputted, working can be immediately started without changing the setup.

Figure 11:
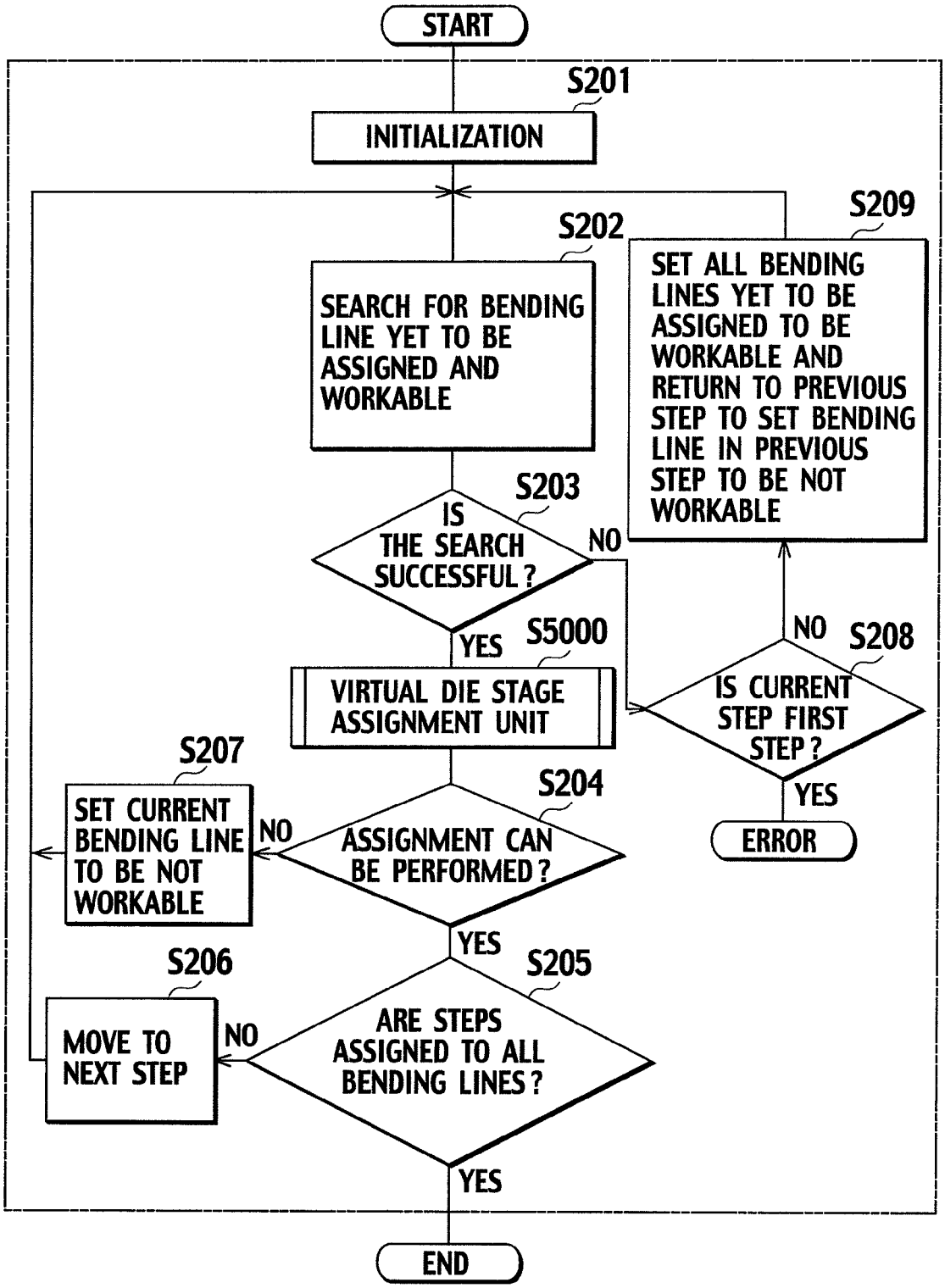
FIG. 11 is a flowchart schematically showing an example of incorporating the virtual die stage assignment processing into a bending order determination unit.

FIG. 11 is a flowchart schematically showing an example of incorporating the virtual die stage assignment processing into the bending order determination unit (details of the portion surrounded by the two-dot chain line in FIG. 1 correspond to a portion surrounded by a two-dot chain line in FIG. 11, and the processing shown in FIG. 1 is performed as a whole).

As shown in FIG. 11, first, initialization is executed (Step S201). Next, a bend line to which no step is assigned yet and which is workable is searched (Step S202). Thereafter, it is determined whether or not the search is successful (Step S203). If the search is successful, assignment processing is performed by the virtual die stage assignment unit (Step S5000). Subsequently, it is determined whether or not assignment can be performed (Step S204). If the assignment can be performed, it is determined whether or not processes are assigned to all the bend lines (Step S205).

If the processes are not assigned to all the bend lines, the processing moves to a next step (Step S206) and returns to Step S202. On the other hand, if the processes are assigned to all the bend lines, the processing is terminated.

Moreover, if it is determined in Step S204 that the assignment cannot be performed, the current bend line is set to be not workable (Step S207) and the processing returns to Step S202.

Moreover, if the search is not successful in Step S203, it is determined whether or not the current process is a first process (Step S208). If the current process is the first process, then this is regarded as an error. Meanwhile, if it is determined in Step S208 that the current process is not the first process, all bend lines yet to be assigned are set to be workable. Thereafter, the processing returns to the previous process to set the bend line in the previous process to be not workable (Step S209).

Figure 12:
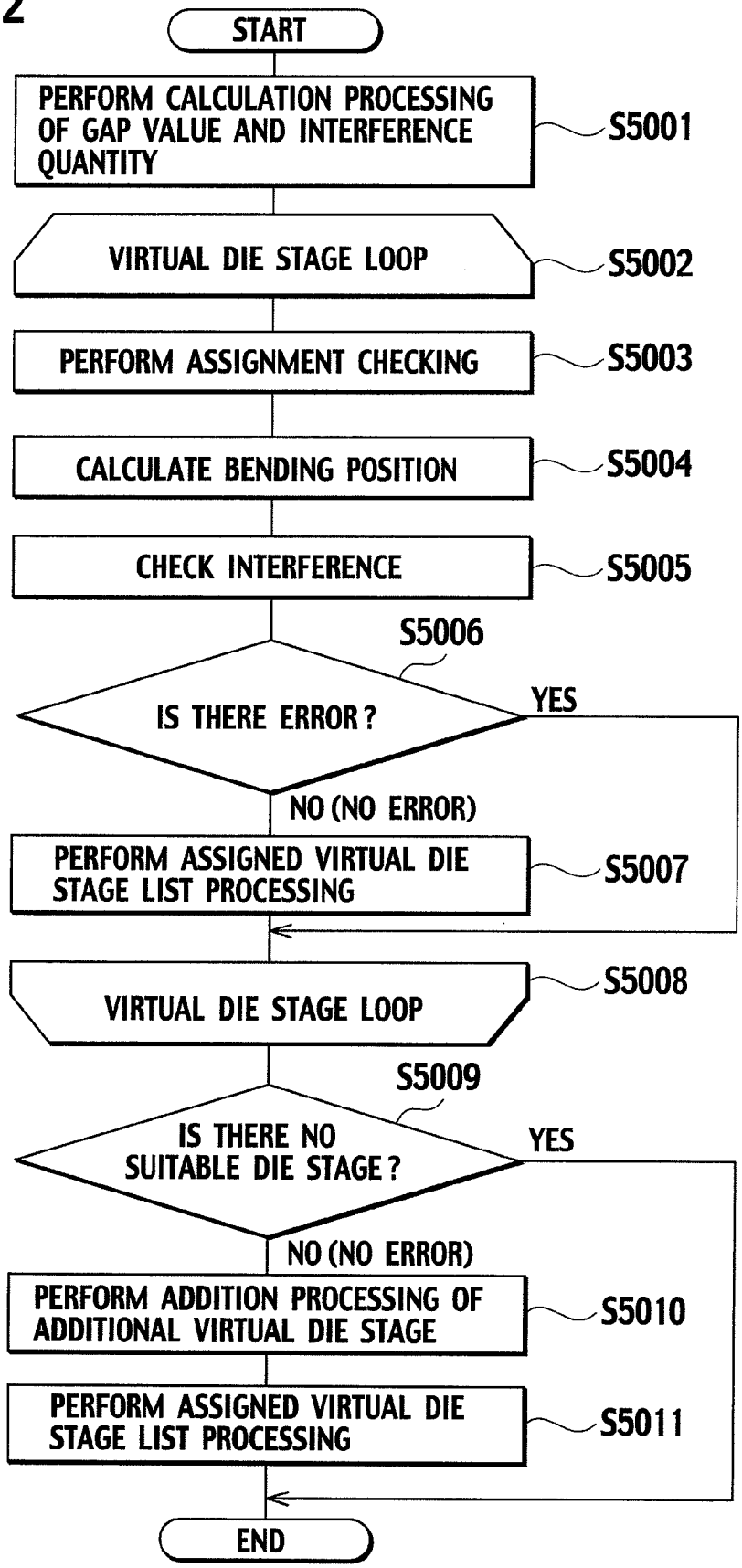
FIG. 12 is a flowchart schematically showing processing executed by a virtual die stage assignment unit.

FIG. 12 is a flowchart schematically showing processing executed by the virtual die stage assignment unit.

As shown in FIG. 12, in the processing executed by the virtual die stage assignment unit, first, gap value and interference quantity calculation processing is performed (Step S5001). In the gap value and interference quantity calculation processing, a gap value and an interference quantity are calculated from a part shape.

Next, processing from Step S5002 to Step S5008 is set as a virtual die stage loop.

Here, first, assignment checking is performed (Step S5003). In the assignment checking, a minimum flange, pressure resistance and a current virtual die stage length are checked.

Next, bending position calculation is performed (Step S5004). In the bending position calculation, a bending position for current virtual die stage candidates in the current process is calculated.

Thereafter, interference checking is performed (Step S5005). In the interference checking, interference in a designated die layout model is checked at the bending position for the current virtual die stage in the current process.

Subsequently, it is determined whether or not there is an error (Step S5006). If there is no error, assigned virtual die stage list processing is performed (Step S5007). In the assigned virtual die stage list processing, a current virtual die stage ID is added to the assigned virtual die stage list, as a assigned die stage candidate for the current process.

Next, it is determined whether or not there is a suitable die stage (Step S5009). If there is no suitable die stage, additional virtual die stage addition processing is performed (Step S5010). In the additional virtual die stage addition processing, a die length, a bending position and an attachment position are calculated.

Thereafter, assigned virtual die stage list processing is performed (Step S5011). In the assigned virtual die stage list processing, the virtual die stage is added to the list, as a virtual die stage candidate for the current process.

According to the present invention as described above, a die layout to be a basis of automatic bending order generation processing can be designated. This designated die layout is set to be, for example, the one already attached to the machine.

Moreover, a portion, in the designated die layout, where the punch and the die face each other, can be set as a virtual die stage.

Moreover, in the automatic bending order generation processing, a die length and interference are checked by use of a list of virtual die stages that can be bent for each bend line. If it is determined that bending can be performed, a bending position can be calculated.

Moreover, if it is determined that bending can be performed in a plurality of stages, a die stage that optimizes material handling efficiency (a distance of movement of an operator on a BP base) can be adopted.

Moreover, if it is determined that bending cannot be performed in any of the virtual die stages, a die stage can be added.

Moreover, a die length of the die stage to be added can be calculated from a bending length and left and right gap amounts.

Moreover, a bending position for the die stage to be added can be calculated from the die length, the bending length and the left and right gap amounts.

Moreover, an attachment position for the die stage to be added can be calculated.

Furthermore, by executing the processing described above, a bending order reusing the die layout already attached to the machine is automatically generated. Thus, an effect of reducing setup operation can be achieved.

Note that the entire contents of Japanese Patent Application No. 2006-187129 (filed: Jul. 6, 2006) are incorporated herein by reference.

The present invention is not limited to the description of the embodiment above, but can be implemented in various other modes by adding appropriate changes thereto.

The invention claimed is:

1. A method for utilizing a bending machine die layout with a bending machine, comprising:

designating a die layout of the bending machine, the designated die layout being defined by existing arrangements of replaceable punches and replaceable dies installed on the bending machine;

extracting, in the designated die layout, portions in each of which a punch and a die face overlapping to each other to be actually used for one of bending processes, as virtual die stages based on punch attachment positions and punch lengths of the punches, and die attachment positions and die lengths of the dies;

assigning, by a calculation unit by using a sheet metal shape model of a bent workpiece planned to be made by the bending machine, bend lines on the sheet metal shape model corresponding to actual bend lines of the bent workpiece, to the virtual die stages; and utilizing the die layout of the bending machine, including the replaceable punches and the replaceable dies installed on the bending machine, for forming the bent workpiece.

2. The method for utilizing a bending machine die layout, according to claim 1, further comprising:

creating a list of the assigned virtual die stages in a bending order.

3. The method for utilizing a bending machine die layout, according to claim 1, wherein when a plurality of the virtual die stages are assignable to some of bending processes required for the bent workpiece, one of the virtual die stages that brings better material handling efficiency is assigned.

4. The method for utilizing a bending machine die layout, according to claim 2, wherein when a plurality of the virtual die stages are assignable to some of bending processes required for the bent workpiece, one of the virtual dies stages that brings better material handling efficiency is assigned.

5. The method for utilizing a bending machine die layout, according to claim 1, further comprising:

when none of the virtual die stages is assignable to one of bending processes required for the bent workpiece, additionally generating a new virtual die stage suitable for the one of bending processes.

6. The method for utilizing a bending machine die layout, according to claim 2, further comprising:

when none of the virtual die stages is assignable to one of bending processes required for the bent workpiece, additionally generating a new virtual die stage suitable for the one of the bending processes.

7. The method for utilizing a bending machine die layout, according to claim 3, further comprising:

when none of the virtual die stage is assignable to one of bending processes required for the bent workpiece, additionally generating a new virtual die stage suitable for the one of bending processes.

8. The method for utilizing a bending machine die layout, according to claim 4, further comprising:

when none of the virtual die stage is assignable to one of bending processes required for the bent workpiece, additionally generating a new virtual die stage suitable for the one of bending processes.

9. A bending workability judgment apparatus for judging bending workability by utilizing a die layout of a bending machine and using a sheet metal shape model of a bent workpiece planned to be made by the bending machine, the apparatus comprising:

a designator configured to designate a die layout as a judgment condition for judging whether or not bending processes are adequate, the designated die layout being defined by existing arrangements of replaceable punches and replaceable dies installed on the bending machine;

an extractor configured to extract portions in each of which a punch and a die face overlapping to each other to be actually used for one of bending processes, as virtual die stages based on punch attachment positions and punch lengths of the punches and die attachment positions and die lengths of the dies;

a specifier configured to specify one of bending processes whose workability to be judged; and a judger configured to judge bending workability in the specified one of bending processes by using one of the extracted virtual die stages, wherein when a result of the judgment of bending workability is positive, a bending location in the die layout for the specified one of bending processes is determined;

wherein a calculating unit assigns the virtual die stages; and wherein the die layout of the bending machine, including the replaceable punches and the replaceable dies installed on the bending machine, are utilized for forming the bent workpiece.

10. A bending order generation apparatus for generating a bending order by utilizing a die layout of a bending machine and using a sheet metal shape model of a bent workpiece planned to be made by the bending machine, the apparatus comprising:

an input unit to which the sheet metal shape model is input for generating a bending order;

a designator configured to designate a die layout as a condition for generating the bending order, the designated die layout being defined by existing arrangements of replaceable punches and replaceable dies installed on the bending machine;

an extractor configured to extract portions in each of which a punch and a die face overlapping to each other to be actually used for one of bending processes, as virtual die stages based on punch attachment positions and punch lengths of the punches and die attachment positions and die lengths of the dies;

a searcher configured to search for the bending order by extracting bend lines on the sheet metal shape model corresponding to actual bend lines of the bent workpiece; and a judger configured to judge bending workability for each of bending processes by using the extracted virtual die stages as conditions for generated the bending order while searcher searches the bending order, wherein when the bending order is successfully searched, the bending order is output together with bending locations in the die layout;

wherein a calculating unit assigns the virtual die stages; and wherein the die layout of the bending machine, including the replaceable punches and the replaceable dies installed on the bending machine, are utilized for forming the bent workpiece.

11. A bending data adaptation apparatus for converting bending data into new bending data adapted to designated die setup of a bending machine, the apparatus comprising:

an input unit to which a sheet metal shape model of a bent workpiece planned to be made by the bending machine and bending data corresponding to the sheet metal shape model are input;

a designator configured to designate a die layout to be adapted, the designated die layout being defined by existing arrangements of replaceable punches and replaceable dies installed on the bending machine;

an extractor configured to extract portions in each of which a punch and a die face overlappingly to each other to be actually used for one of bending processes, as virtual die stages based on punch attachment positions and punch lengths of the punches and die attachment positions and die lengths of the dies; and a searcher configured to search for a suitable virtual die stage for every bending process by judging bending workability in the every bending process according to a bending order specified by the bending data, wherein when virtual die stages suitable for all of the bending processes are found, the new bending data is output together with bending location in the die layout;

wherein a calculating unit assigns the virtual die stages; and wherein the die layout of the bending machine, including the replaceable punches and the replaceable dies installed on the bending machine, are utilized for forming the bent workpiece.

* * * * *

UNITED STATES PATENT AND TRADEMARK OFFICE

CERTIFICATE OF CORRECTION

PATENT NO. : 8,322,173 B2
APPLICATION NO. : 12/307004
DATED : December 4, 2012
INVENTOR(S) : Akira Senba It is certified that error appears in the above-identified patent and that said Letters Patent is hereby corrected as shown below:

In the Claims

At column 13, line 53 (claim 7, line 3) of the printed patent, “stage” should read --stages--.

At column 13, line 59 (claim 8, line 3) of the printed patent, “stage” should read --stages--.

Signed and Sealed this
Sixteenth Day of July, 2013

Teresa Stanek Rea
*Acting Director of the United States Patent and Trademark Office*